US005791984A

United States Patent [19]

Kane

[11] Patent Number: 5,791,984

[45] Date of Patent: Aug. 11, 1998

[54] AIR HANDLING SYSTEM WITH SNOW REMOVAL CAPABILITIES

[75] Inventor: David M. Kane, Darien, Conn.

[73] Assignee: Mistop, Inc., Norwalk, Conn.

[21] Appl. No.: 833,633

[22] Filed: Apr. 8, 1997

Related U.S. Application Data

[63] Continuation of Ser. No. 551,571, Nov. 1, 1995, abandoned.

[51] Int. Cl.[6] ..... F24F 3/16

[52] U.S. Cl. ..... 454/276; 55/525; 219/201; 454/254

[58] Field of Search ..... 454/254, 276, 454/338; 55/209, 280, 342, 525; 219/201

[56] References Cited

U.S. PATENT DOCUMENTS 3,850,229 11/1974 Pelabon ..... 165/44
5,074,117 12/1991 Kane et al. ..... 62/93
5,191,767 3/1993 Kane et al. ..... 60/728

FOREIGN PATENT DOCUMENTS 62-19627 1/1987 Japan ..... 454/276

*Primary Examiner*—Harold Joyce
*Attorney, Agent, or Firm*—St. Onge Steward Johnston & Reens LLC

[57] ABSTRACT

A process and system is provided for treating the air being taken into a building so as to remove moisture, especially snow, from the intake air. The system includes a series of air passages through the building; generating a flow of air through the series of air passages, wherein air is taken from outside the building; and, advantageously, reducing the content of snow in the intake air by passing the intake air through a mesh pad having a heating means disposed at its intake surface.

13 Claims, 2 Drawing Sheets

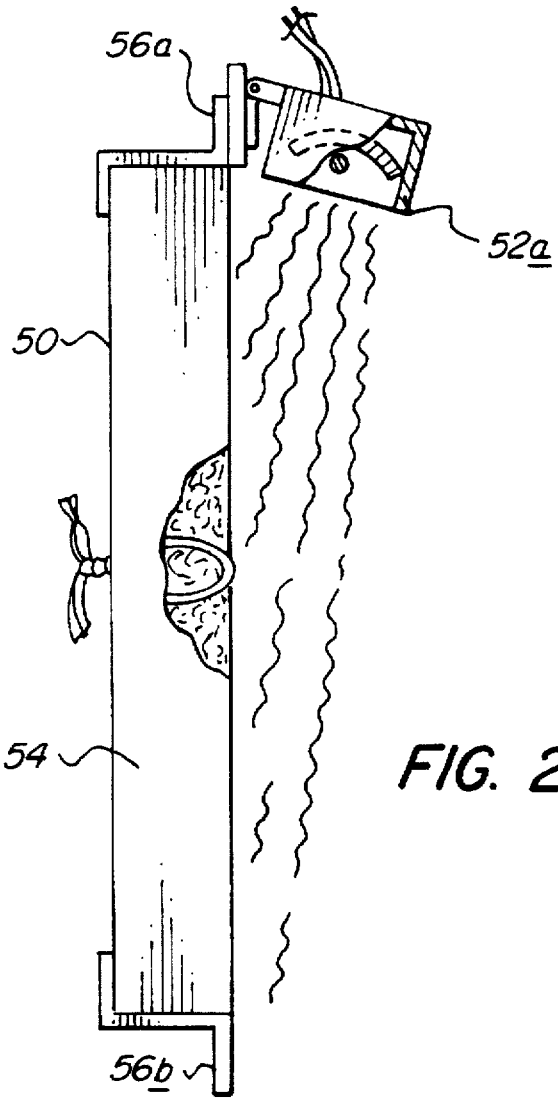
FIG. 2
FIG. 3
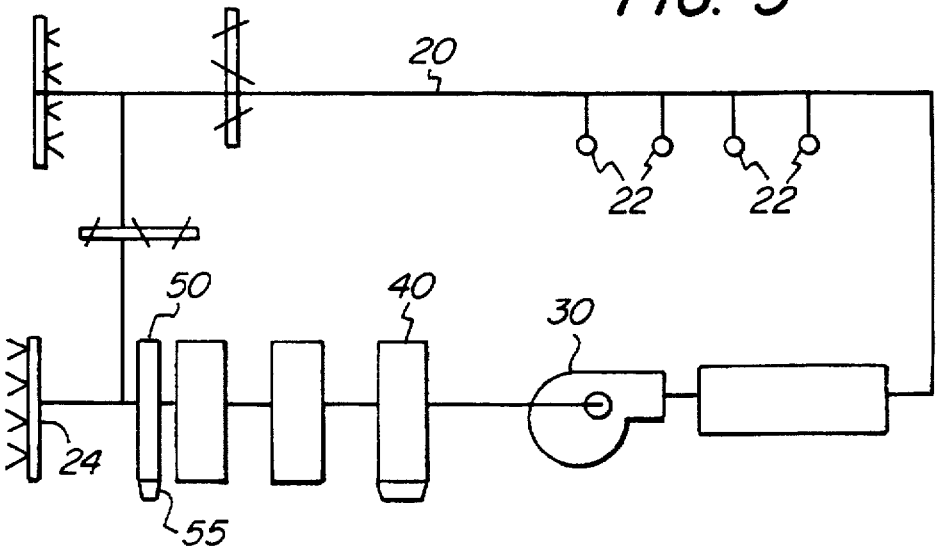

AIR HANDLING SYSTEM WITH SNOW REMOVAL CAPABILITIES

This application is a continuation of copending application Ser. No. 08/551,571 filed on Nov. 1,1995, now abandoned.

TECHNICAL FIELD

The present invention relates to an air handling system and process which is capable of circulating air through a building for ventilation, heating, or dehumidification purposes. This system generally comprises a source of intake air, a series of air passages operatively connected to the source of intake air and disposed throughout a building, through which is generated a flow of the intake air, and means for reducing the content of snow in the intake air comprising a mesh pad having a heating means disposed at its intake surface.

Many conventional ventilation, heating and dehumidification systems are described in the American Society of Heating Refrigeration and Air Conditioning Engineers ("ASHRAE") 1989 Fundamentals Handbook (ASHRAE Handbook"). Such systems generally include appropriate air passages, at least one fan, and heating coil(s). In addition, such systems may also include other desired elements such as filters, air mixers, dampers, modulating devices, and other control and/or monitoring components to direct and otherwise control the flow of air through the passages.

Commonly, the air which is being heated or dehumidified is brought into the system through intake vents and thus is brought in from outside the building. At times this intake air may contain snow or water droplets which can damage the air circulation system due to corrosion and other moisture related problems. In extreme situations, the snow and water droplets can actually be passed along the system and enter the offices, rooms, etc. of the building. Merely melting the snow using heaters, etc. is not enough, since the resulting water droplets remain entrained in the air flowing through the system, and condense or are otherwise deposited in areas where the water can cause damage due to corrosion, staining, spoilage, or other moisture related problems, such as bacterial growth.

Presently, there are devices which will eliminate water from entrained air. Such moisture elimination devices generally utilize chevron-style moisture eliminators which rely on the impingement of entrained water droplets on the eliminator surfaces. The droplets then run down the chevron blades, and are collected or drained in suitable apparatus.

These chevron moisture eliminators are generally "three-bend" or "six-bend" type eliminators, and are usually mounted up to six feet from the heating coil. In most commercial installations, chevron moisture eliminators must be at least 6 inches deep for adequate reduction of entrained water. Unfortunately, chevron-type moisture eliminators are difficult and costly to manufacture and install; they lead to a relatively high pressure drop through the system, which is directly translatable to high energy use, and thus high operating cost; and they require substantial space, which can often not be accommodated, especially in the case of retrofit installations in an existing system where no additional space is available.

In a unique approach to moisture elimination, Kane and Fry, in U.S. Pat. No. 5,074,117, describe a system whereby a metallic mesh pad is arranged to eliminate the entrained moisture from an air flow after it has exited the cooling coils of an air handling system. The Kane/Fry metallic mesh pad overcomes most, if not all, of the disadvantages of the conventional chevron-type moisture eliminators.

However, the Kane/Fry metallic mesh pad is not capable of removing snow from the intake air of an air handling system without the potential for snow-related damage, etc.

What is desired, therefore, is an air handling system which is effective at ventilation, heating, or dehumidification, yet which is able to eliminate substantial amounts of snow and/or water droplets and resulting moisture from the intake air flow in a practical and efficient manner.

DESCRIPTION OF INVENTION

The present invention relates to a process and system for handling the ventilation, heating, or dehumidification of the air in a building, which comprises providing a source of intake air and a series of air passages operatively connected to the source of intake air and disposed through the building; generating a flow of air from the source of intake air and through the air passages; and substantially eliminating any snow when present in the intake air by passing the intake air flow through a mesh pad having a heating means disposed at its intake surface.

DESCRIPTION OF THE DRAWINGS

The invention will be better understood and its advantages will become more apparent from the following detailed description, especially when read in light of the attached drawings, wherein:

FIG. 2 is a partial cross-section view of an alternate embodiment of the moisture eliminator of FIG. 1; and FIG. 3 is a schematic illustration of one embodiment of an air handling system useful in the claimed invention.

DETAILED DESCRIPTION OF THE PREFERRED EMBODIMENT

Figure 1:
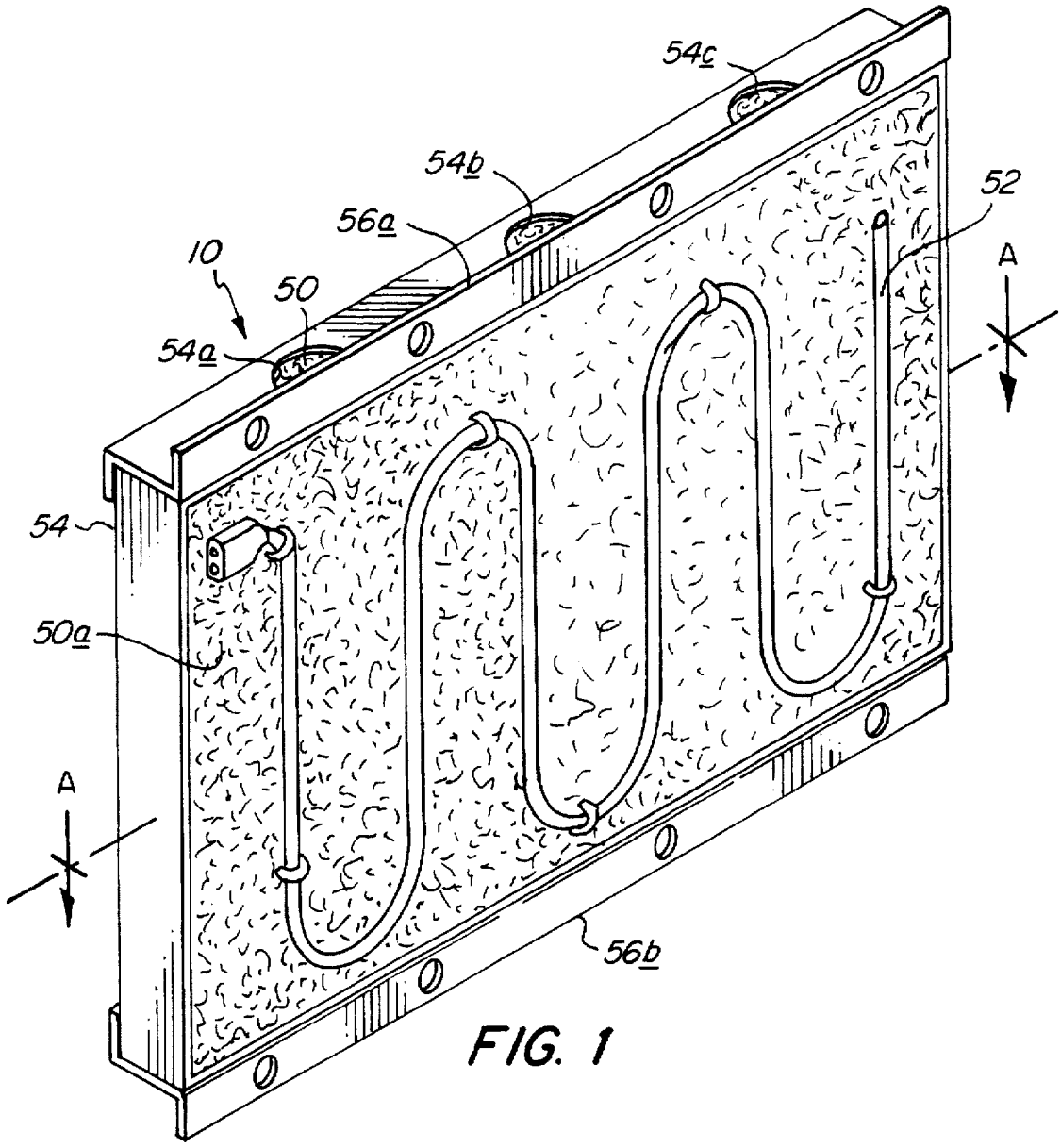
FIG. 1 is an isometric view of a knitted, mesh pad moisture eliminator useful in the claimed invention.

Referring to the drawings, an air handling system in accordance with the invention is generally indicated by the reference numeral 10. It should be noted that for the sake of clarity all the components and parts of air handling system 10 are not shown and/or marked in all the drawings. In addition, the terms "top" and "bottom" refer to the orientation illustrated in FIG. 1. It will be understood though, that the illustrated orientation is not necessary for operability of air handling system 10.

The present invention relates to a process for the ventilation, heating, or dehumidification of the air in a building, as well as an air handling system 10 for effecting the process. This process generally comprises providing a source of intake air, a series of air passages operatively connected to the source of intake air and disposed throughout a building, generating a flow of air through these passages, and reducing the snow content of the intake air (during the winter months) by passing it through a knitted, mesh pad having a heating means at its intake surface.

The buildings in which the process and system of the present invention may be utilized include office buildings, apartment buildings, laboratories, health care facilities such as hospitals and nursing homes, hotels or motels, educational institutions such as schools and universities, as well as private residences. In addition, the inventive process and system can be used in factories, manufacturing facilities, or to her business establishments such as research and development facilities, and are effective wherever air heating, ventilation, or dehumidification is desired without snow or moisture from melted snow in the air. For instance, in manufacturing plants for computer chips, excess moisture can be extremely disadvantageous as it can compromise computer chip purity or quality.

Generally, the air passages 20 provided according to the process of the invention comprise the heating/ventilation/air conditioning ducts or passages throughout the building, although other suitable air conduits throughout the building may be utilized. Air passages 20 generally run from a central area (usually located either on the roof or in the basement of the building), where many of the other elements of the system are disposed, through the internal spaces of the building with vents or other output elements 22 disposed in rooms or areas for which ventilation, heating, dehumidification, etc., is desired. In addition, air passages 20 have associated therewith intake or other input means 24 exposed to the outside environment in order to draw air into system 10 and output means 26 in order to expel air from system 10.

The present invention further involves generating a flow of air through the series of air passages 20. This is accomplished through at least one flow means which is suitable for causing an air flow of the desired velocity (preferably above 500 fpm, more preferably about 500 fpm to about 800 fpm). This air flow generating means generally comprises a fan 30 having sufficient power to cause the desired flow of air through system 10. Although only one fan 30 is needed, it is also possible to dispose more than one fan throughout system 10 in order to maintain a steady and consistent flow of air. Suitable fans for use in system 10 of the present invention would be familiar to the skilled artisan and are conventional in the art.

The process of the present invention advantageously also involves heating the air flow generated by fan 30 by a heating means comprised of at least one heating coil 40. Heating coil 40 can comprise a conduit through which a heating medium flows. Alternatively, heating means 40 can comprise a source of radiant or resistant heating, as would be familiar to the artisan.

In order to heat the air with as much efficiency as possible, it is preferred to pass the air flow across heating coil 40 in a manner intended to contact as much surface area of heating coil 40 with the air flow as possible. To do so, heating coil 40 can advantageously be configured as rows of tubes which are staggered or disposed in line with respect to the air flow. In a preferred embodiment, the individual tube passes of heating coil 40 are interconnected by return bends to form a serpentine arrangement, as would be familiar to the skilled worker in the field. In addition, heating coil 40 can be formed as a plurality of heating coils arranged in combination or in series.

Heating coil 40 can be formed from any suitable water resistant material, including copper, brass, aluminum, and stainless steel, although copper and brass are preferred due to their strength and resistance to corrosion. Depending on the application, heating coil 40 can be of various sizes based upon the cubic feet of air flowing across heating coil 40 per minute. It is not unusual for heating coil 40 to be up to 20 feet wide or more, and at least 12 feet high. Generally, such heating coils would be made up of smaller sized sections (not shown), which are stacked or otherwise combined to provide the desired size for heating coil 40. In most applications, heating coil 40 can vary between about 0.5 feet wide to about 50 feet wide, and about 0.5 feet high to about 50 feet high. Preferably, heating coil 40 is between about 4 and about 4 feet wide and about 2 and about 20 feet high. As noted, heating coil 40 can be comprised of a single, unitary heating coil or a series of heating coil sections.

The process of the present invention further comprises reducing the amount of snow (when present) and resulting moisture of the intake air by passing the intake air flow through an elimination means comprising a mesh pad 50 which is disposed up to about six feet upstream from heating coil 40 for greatest efficiency.

Indeed, mesh pad 50 should be disposed as near intake means 24 as possible to minimize the damage which may be caused by snow in air passage 20. Mesh pad 50 has an intake side 50*a*, that is, the side of mesh pad 50 that the intake air encounters first. Mesh pad 50 has a heating means disposed at its intake side 50*a* which heats and, thusly, melts snow entrained in the intake air, forming water droplets.

As its name implies, mesh pad 50 comprises a mass of fibrous strands bunched together in a bundled mass, and is usually prepared by "knitting" of the component fibers. Because of its nature, "knitted", mesh pad 50 serves to eliminate a substantial portion of the entrained water formed by melting of snow by heating means 52. Although not wishing to be bound by any theory, it is believed that mesh pad 50 captures water vapor or droplets in the air flow by inertial impaction. Dry air passes through mesh pad 50 with relatively little resistance, but the density of mesh pad 50 is such that water vapor or droplets impact thereon and join with others, which then run down to suitable collection or drain means, as discussed in more detail below.

Figure 1A:
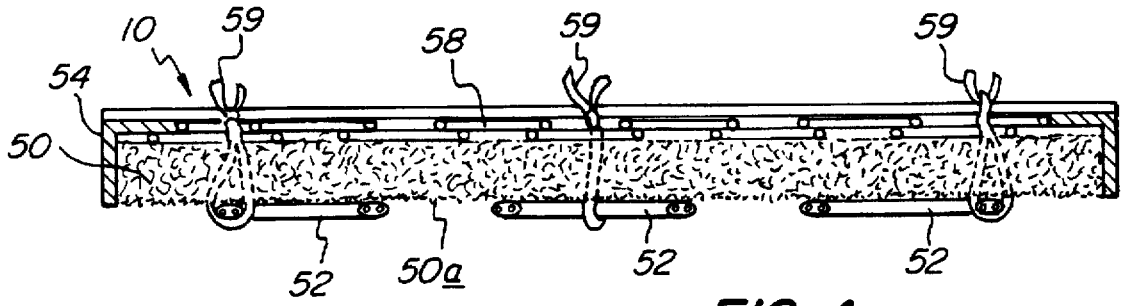
FIG. 1*a* is a cross-sectional view of the moisture eliminator of FIG. 1, taken along lines A—A.

Generally, mesh pad 50 is contained within a frame 54 which can be attached to and within air passages 20. Most advantageously mesh pad 50 is the first apparatus encountered by the intake air in system 10. Frame 54, as illustrated in FIGS. 1 and 1*a*, is a suitable retaining means for maintaining mesh pad 50 in position such that the air flow passes through mesh pad 50. Frame 54 is configured in the shape mesh pad 50 is to assume. Advantageously, frame 54 is rectangular in shape air passages 20 are most often rectangular in shape.

Frame 54 can also comprise holes or ports, 54*a*, 54*b*, and 54*c*for draining of moisture eliminated from the air flow. Moisture eliminated from the air flow by mesh pad 50 can drain through ports 54*a*, 54*b*, and 54*c*to a draining pan. Ports 54*a*, 54*b*, and 54*c*are preferably disposed both at the top and at the bottom of frame 54 to allow an installer to install frame 54 without regard to orientation. Ports 54*a*, 54*b*, and 54*c*, can be any size or in any suitable number or pattern to adequately pass the melted snow-moisture eliminated from the air flow to collection or drain means 55. In addition, frame 54 can also comprise attachment flanges 56*a* and 56*b*, which can be used to attach frame 54 (and, therefore, mesh pad 50) to the air passage 20. Frame 54 is preferably mounted to air passages 20 so as to maintain mesh pad 50 in a generally vertical orientation.

Advantageously, as illustrated in FIGS. 1 and 1*a*, frame 54 further comprises a grid or retaining means 58 which is disposed across the downstream side of frame 54 and mesh pad 50 (that is, the side opposite intake side 50*a*). Grid 58 serves to prevent mesh pad 50 from being forced out of frame 54 (and thereby out of optimal position) by the force of the air flow through mesh pad 50. Preferably, grid 58 and mesh pad 50 are attached through means such as ties 59 to assist in the maintenance of mesh pad 50 in position.

The size of mesh pad 50 and frame 54 will vary depending upon the air passage 20 in which it is being disposed, since it is desirable to have mesh pad 50 disposed across the entire passage 20 so that virtually all of the air flow passes through mesh pad 50. Accordingly, mesh pad 50 and frame 54 are preferably about 0.5 feet to about 50 feet in width, more preferably about 4 feet to about 40 feet, and about 0.5 feet to about 50 feet in width, more preferably about 2 feet to about 20 feet.

The depth and density of mesh pad 50 of the present invention can vary depending on the anticipated duty. Generally, the depth of mesh pad 50 will be between about 0.5 and about 6 inches, preferably between about 1 and about 3 inches, although greater depth can also be anticipated. The density of mesh pad 50 is preferably about 3 pounds per cubic feet (lbs/ft$^3$) to about 12 lbs/ft$^3$), more preferably about 4 lbs/ft$^3$ to about 6 lb/ft$^3$. It will be recognized that as density increases, depth can decrease and as depth increases, density can decrease. These two factors can be adjusted to provide maximum efficiency with minimum space usage. Frame 54 should, but does not have to, have the same depth as mesh pad 50 for greatest stability.

Generally, mesh pad 50 can be formed of stainless steel, aluminum, copper, or non-metallic knitted meshes (such as fiberglass, polyethylene, etc.) of various gauges. Although any material which is relatively resistant to degradation or corrosion by extensive exposure to moisture can be utilized, it is advantageous to utilize a metal because it may be contrary to local fire protection codes to position a flammable material such as polyethylene in an air handling system. Typically, mesh gauges are about 0.003 inches to about 0.015 inches for mesh pad 50 of the present invention, more preferably about 0.010 inches to about 0.013 inches, although this can vary depending on the desired mesh density and depth.

Frame 54 in which mesh pad 50 is disposed can likewise be formed of any suitable material resistant to moisture, such as stainless steel, aluminum galvanized steel, carbon steel, especially with corrosion preventing coatings, as well as non-metallic materials such as high density plastic, with the required dimensional stability. Similarly, grid 58 disposed across frame 54 for retaining knitted, mesh pad 50 in place can also be stainless steel, aluminum, galvanized steel, or a non-metallic material having the required strength.

A suitable mesh pad 50, frame 54, grid 58 and ties 59 are shown in U.S. Pat. No. 5,074,117 to Kane and Fry, the disclosure of which is incorporated herein by reference.

Since the air flow through mesh pad 50 is essentially straight, there is less resistance to air flow and thus, less pressure drop across mesh pad 50 of the present invention as compared with chevron-type moisture eliminators. In addition, the space required for installation of mesh pad 50 is less than that for chevron eliminators, 3- or 6-bend moisture eliminators which measure 3 inches and 12 inches respectively. Moreover, installation is generally easier since it usually only requires attachment by screw or other type means of frame 54 containing mesh pad 50.

A heating means is disposed at the intake side of mesh pad 50 in order to melt snow in the intake air can comprise any means suitable for providing sufficient heat to the intake air to melt at least some of the snow contained therein. Preferably, the heating means provides sufficient heat to melt substantially all or all of the snow contained in the intake air.

To that end, the heating means can comprise a heat tracer 52, that is a flexible resistance heating element which can be arrayed across intake side 50*a* of mesh pad 50 (as illustrated in FIG. 1). Heat tracer 52 can be connected to any suitable electric source (not shown), and, provided it is arrayed sufficiently across intake side 50*a*, can melt a sufficient amount, and preferably all, of the snow in the intake air to water so as to maintain a substantially clear air path. The water from the melted snow can then be eliminated by mesh pad 50. Heat tracer 52 can be maintained in place by ties 59, to grid 58 such as those which mount mesh pad 50 to grid 58. Indeed, those same ties 59 which attach mesh pad 50 to grid 58 can be used to attach heat tracer 52 to grid 58, as illustrated in FIGS. 1 & 1*a*.

In an alternative embodiment, illustrated in FIG. 2, heating means 52 can comprise a source of radiant heat 52*a*, as would be familiar to the artisan, disposed at the intake side 50*a* of mesh pad 50. The source of radiant heat 52a can be mounted to frame 54, either of flanges 56*a* and 56*b*, or directly to air passages 20, provided that its heat is directed such that snow in the intake air is melted before the intake air strikes mesh pad 50.

It will also be recognized that air handling system 10 can comprise other elements useful in providing ventilation, cooling, heating or dehumidification.

Included among these are dampers, filters, intakes, and vents, and other control or modulating elements.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

What is claimed is:

1. An air handling system comprising:

a) a series of air passages disposed within a building;

b) a source of intake air through which air enters the series of air passages;

c) flow means for generating a flow of air through said series of air passages;

d) elimination means disposed within said series of air passages so as to be contacted by the intake air, said elimination means comprising a mesh pad having an intake side, in order to reduce the moisture level of the flow of air; and e) heating means disposed at the intake side of the elimination means, the heating means comprising a resistance heating element arrayed across the intake side of the mesh pad.

2. The system of claim 1 wherein said series of air passages comprises the heating/ventilation/air conditioning ducts of a building.

3. The system of claim 2 wherein the building in which said ducts are disposed comprises a building selected from the group consisting of an office building, an apartment building, a health care facility, a hotel, an educational institution, manufacturing facility, research and development facility, and a private residence.

4. The system of claim 1 wherein said flow means comprises at least one fan apparatus.

5. The system of claim 1 wherein the mesh pad comprises a material selected from the groups consisting of stainless steel, aluminum, copper, fiberglass, and combinations thereof.

6. The system of claim 5 wherein the mesh pad is retained within a frame composed of a material selected from the group consisting of stainless steel, galvanized steel, carbon steel, aluminum, a high density plastic material, and combinations thereof.

7. The system of claim 1 wherein the heating means comprises a heat tracer.

8. A process for treating the air in a building comprising:

a) providing a series of air passages through the building;

b) generating a flow of air through said series of air passages;

c) reducing the melted snow-moisture level of the air flow by passing the air flow though a mesh pad comprising an intake side and having a heating means comprising a resistance heating element arrayed across the intake side of the mesh pad for melting at least some of the snow striking the mesh pad.

9. The process of claim 8 wherein said series of air passages comprises the heating/ventilation/air conditioning ducts of a building.

10. The process of claim 9 wherein the building in which said ducts are disposed comprises a building selected from the group consisting of an office building, an apartment building, a health care facility, a hotel, an educational institution, manufacturing facility, research and development facility, and a private residence.

11. The process of claim 8 wherein said knitted, mesh pad comprises a material selected from the groups consisting of stainless steel, aluminum, copper, fiberglass, and combinations thereof.

12. The process of claim 11 wherein said mesh pad is retained within a frame composed of a material selected from the group consisting of stainless steel, galvanized steel, carbon steel, aluminum, a high density plastic material, and combinations thereof.

13. The system of claim 8 wherein the intake air is heated by use of a heat tracer.

* * * * *